US005973248A

United States Patent [19]

Chen

[11] Patent Number: 5,973,248

[45] Date of Patent: Oct. 26, 1999

[54] COMBINATION SIDE-DRUM HOLDER

[75] Inventor: Erh-Chiang Chen, Taichung Hsien, Taiwan

[73] Assignee: Tay E Co. Ltd., Taichung Hsien, Taiwan

[21] Appl. No.: 09/133,488

[22] Filed: Aug. 12, 1998

[51] Int. Cl.[6] ..... G10D 13/02

[52] U.S. Cl. ..... 84/421; 248/441.1; 84/327

[58] Field of Search ..... 84/421, 327; 248/278.1, 248/441.1; 70/235

[56] References Cited

U.S. PATENT DOCUMENTS 4,453,442 6/1984 LaFlame ..... 84/421
5,660,364 8/1997 Hsieh ..... 248/309.1
5,804,747 9/1998 Chen ..... 84/327
5,895,874 4/1999 Liao ..... 84/421

*Primary Examiner*—Robert E. Nappi
*Assistant Examiner*—Kim Lockett
*Attorney, Agent, or Firm*—Bacon & Thomas, PLLC

[57] ABSTRACT

A combination side-drum holder includes a mounting unit having a mounting plate fastened to the shell of a base drum to hold a sliding bar and a holding down block for fixing the sliding bar in position, and a holder unit fastened to an upright support rod at one end of the sliding bar to hold a pair of side drums, the holder unit including two ball socket halves fastened together, two balls rotatably mounted in between the ball socket halves and held down in position when the ball socket halves are fastened tight, and two supporting rods respectively connected to the balls and extended to the outside for holding a respective side drum.

4 Claims, 7 Drawing Sheets

COMBINATION SIDE-DRUM HOLDER

BACKGROUND OF THE INVENTION

The present invention relates to a combination side-drum holder, and more particularly to an adjustable combination tom-tom holder which can be conveniently adjusted forwards and backwards on the base drum and turned to move each side drum carried thereon to the desired angle.

In a drum set, aerial tom-toms (side drums) are mounted a tom-tom holder at the shell of the base drum (see FIG. 1). The tom-tom holder, as shown in FIG. 2, is comprised of a mounting base fixedly fastened to the shell of the base drum by screws, a holder block raised from the mounting base, the holder block having two vertical coupling holes at the top and two horizontal screw holes respectively perpendicularly extended from the vertical coupling holes to the periphery of the holder block, two supporting rods respectively mounted in the vertical coupling holes for holding a side drum each, and two tightening up screws respectively threaded into the screw holes to secure the supporting rods in place. When the tom-tom holder is fastened to the shell of the base drum, it cannot be adjusted to change the position of the supporting rods forwards or backwards relative to the head of the base drum or the player. In order to fit the player, the tom-tom holder must be custom-made. However, a tom-tom holder made to order is expensive.

SUMMARY OF THE INVENTION

It is the main object of the present invention to provide a combination side-drum holder which can conveniently adjusted forwards and backwards to the desired position on the base drum and turned to move each side drum carried thereon to the desired angle. It is another object of the present invention to provide a combination side-drum holder which is easy to install. According to one embodiment of the invention, the combination side-drum holder comprises a mounting unit having a mounting plate fastened to the shell of a base drum to hold a sliding bar and a holding down block for fixing the sliding bar in position, and a holder unit fastened to an upright support rod at one end of the sliding bar to hold a pair of side drums, the holder unit comprising two ball socket halves fastened together, two balls rotatably mounted in between the ball socket halves and held down in position when the ball socket halves are fastened tight, and two supporting rods respectively connected to the balls and extended to the outside for holding a respective side drum.

DETAILED DESCRIPTION OF THE PREFERRED EMBODIMENT

Figure 1:
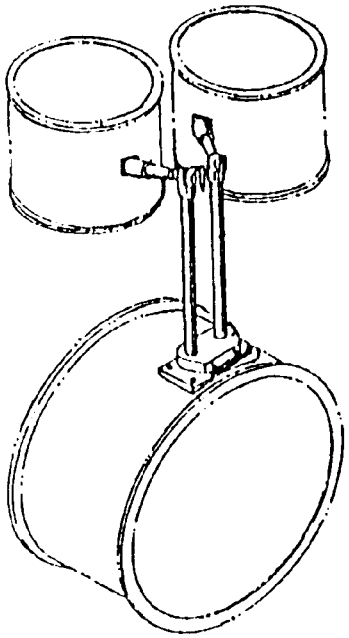
Fig. 1 PRIOR ART
FIG. 1 is shows tom-toms carried on a tom-tom holder at the shell of a base drum according to the prior art.
Figure 2:
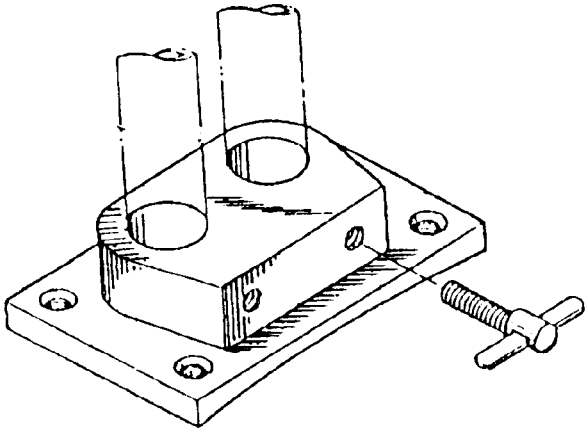
Fig. 2 PRIOR ART
FIG. 2 is an exploded view in an enlarged scale of the tom-tom holder shown in FIG. 1.
Figure 3:
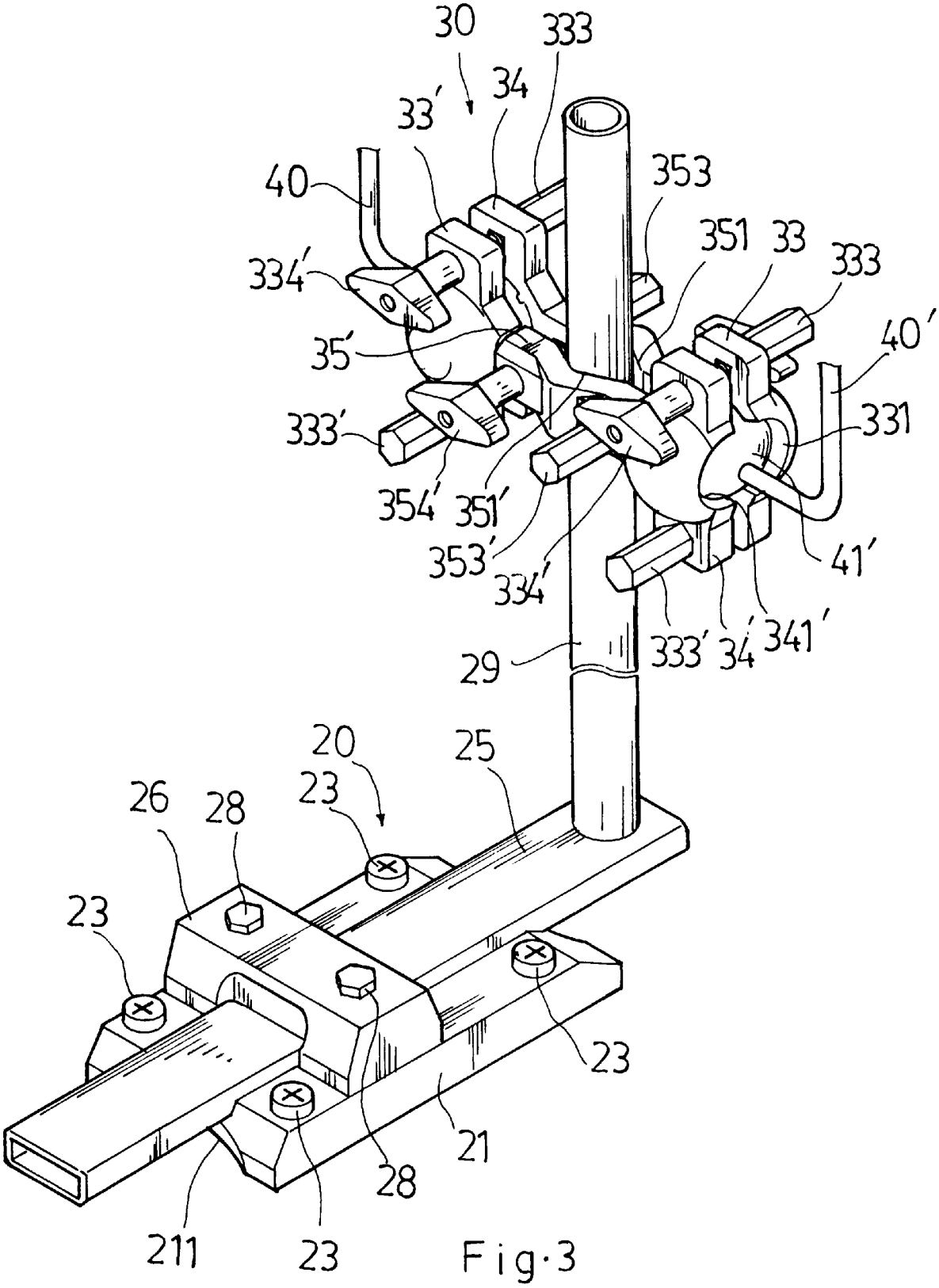
FIG. 3 is a perspective view of a combination side-drum holder according to the present invention.

Referring to FIGS. 3, a combination side-drum holder in accordance with the present invention is comprised of a mounting unit 20 and a holder unit 30, and designed for fastening to the shell of a base drum to hold a pair of side drums (tom-toms).

Figure 6:
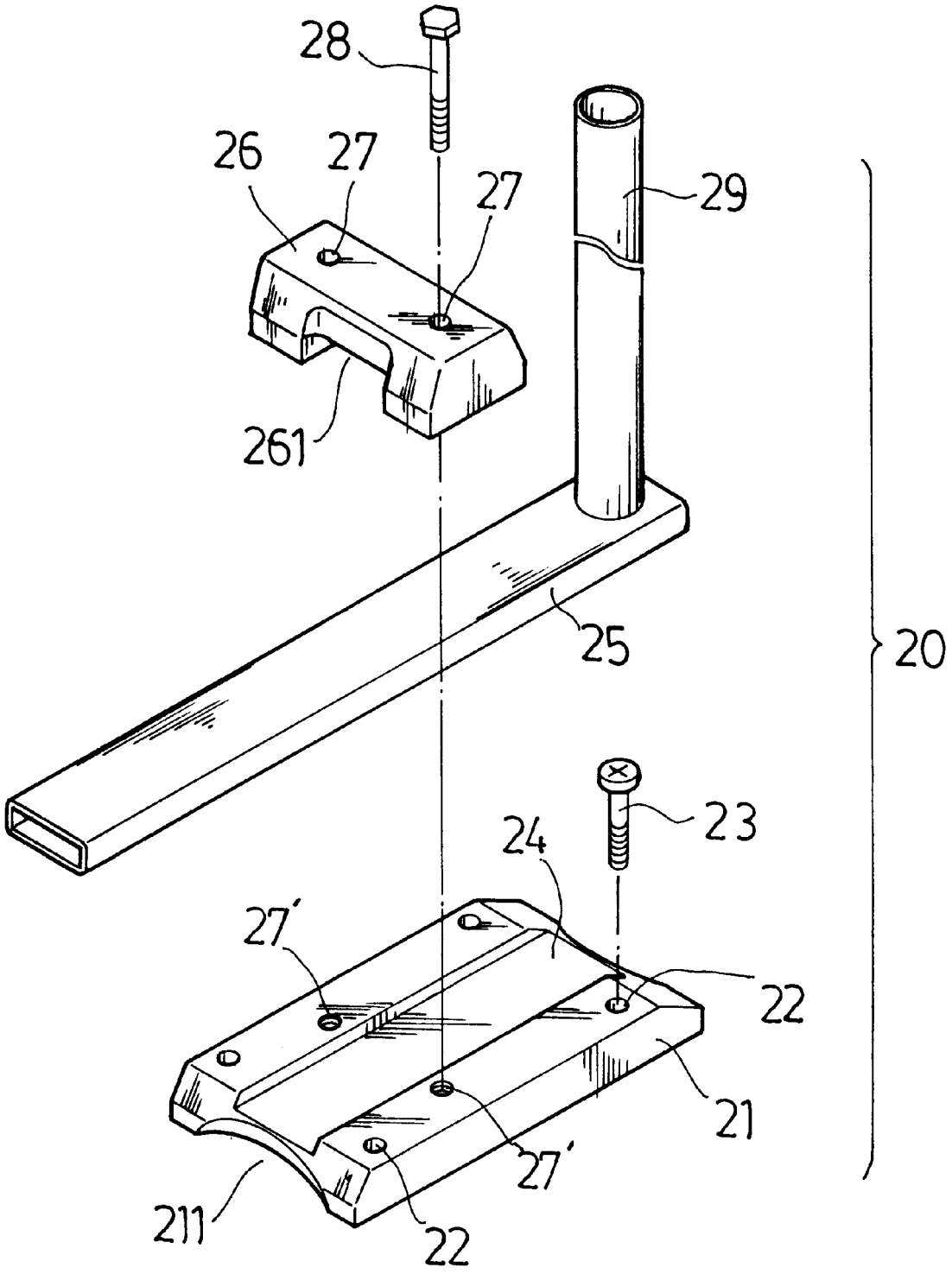
FIG. 6 is an exploded view of the mounting unit of the combination side-drum holder according to the present invention.

Referring to FIG. 6 and FIG. 3 again, the mounting unit 20 is comprised of a mounting plate 21, a flat sliding bar 25, an upright support rod 29, and a holding down block 26. The mounting plate 21 comprises a smoothly curved bottom side wall 211 fitting the curvature of the shell of the base drum (not shown), a longitudinal sliding groove 24 longitudinally extended through the length at the top side thereof, pairs of first mounting holes 22 disposed at two opposite sides of the longitudinal sliding groove 24 near the border and respectively fastened to the shell of the base drum by for example screw bolts 23, and two second mounting holes 27' disposed at two opposite sides of the longitudinal sliding groove 24 on the middle. The flat sliding bar 25 is moved back and forth in the longitudinal sliding groove 24 at the mounting plate 21, and fixed in position by the holding down block 26. The thickness of the flat sliding bar 25 is greater than the depth of the longitudinal sliding groove 24. The upright support rod 29 is integral with and perpendicularly raised from the sliding bar 25 near one end. The holding down block 26 is transversely mounted on the mounting plate 21 at the top to hold down the sliding bar 25 in position, comprising two mounting holes 27 respectively fastened to the second mounting holes 27' at the mounting plate 21 by a respective fastening element for example a screw bolt 28, and a recessed portion 261 transversely disposed at the bottom side wall thereof on the middle, which receives the sliding bar 25.

Figure 4:
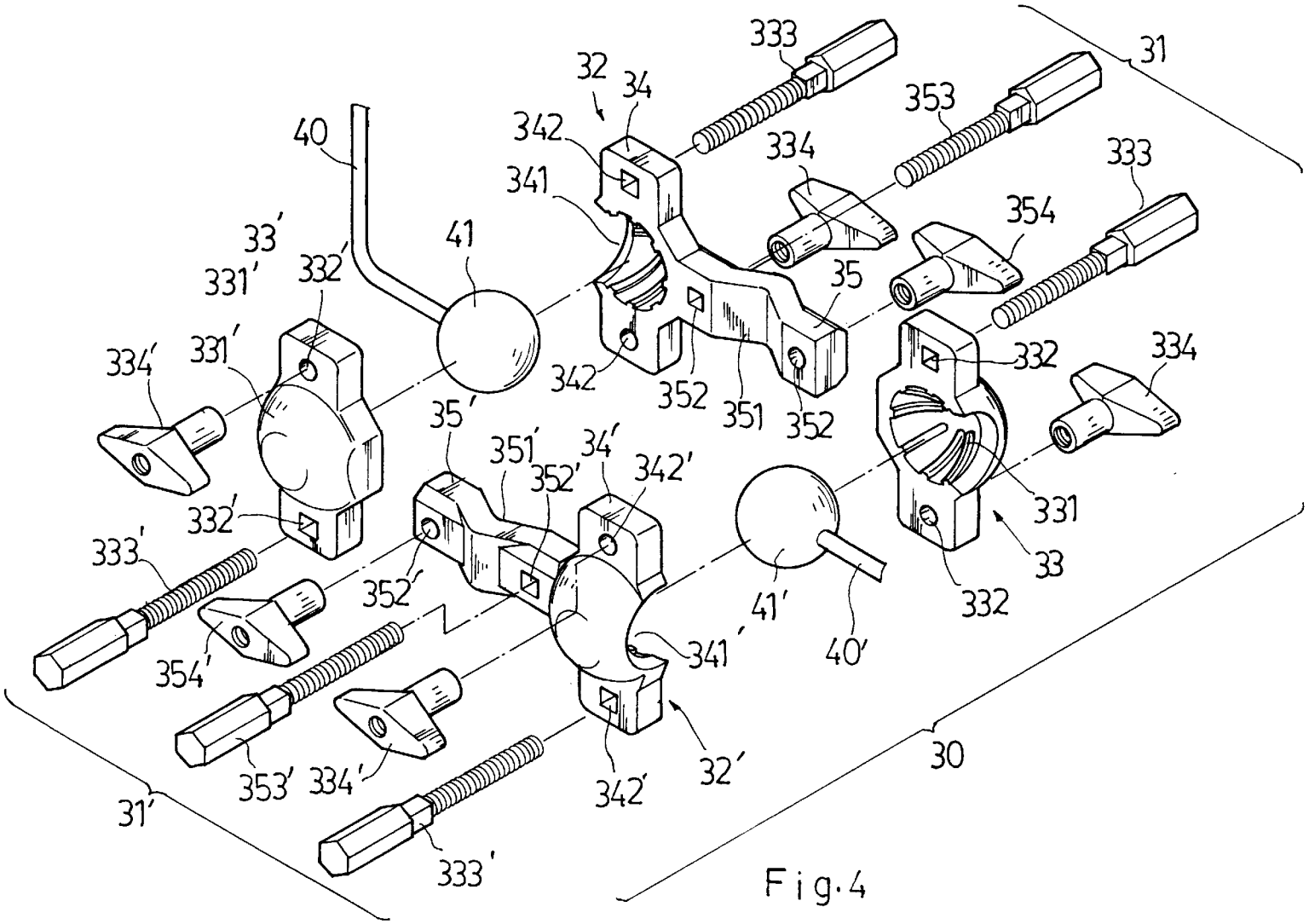
FIG. 4 is an exploded view of the holder unit of the combination side-drum holder according to the present invention.
Figure 5:
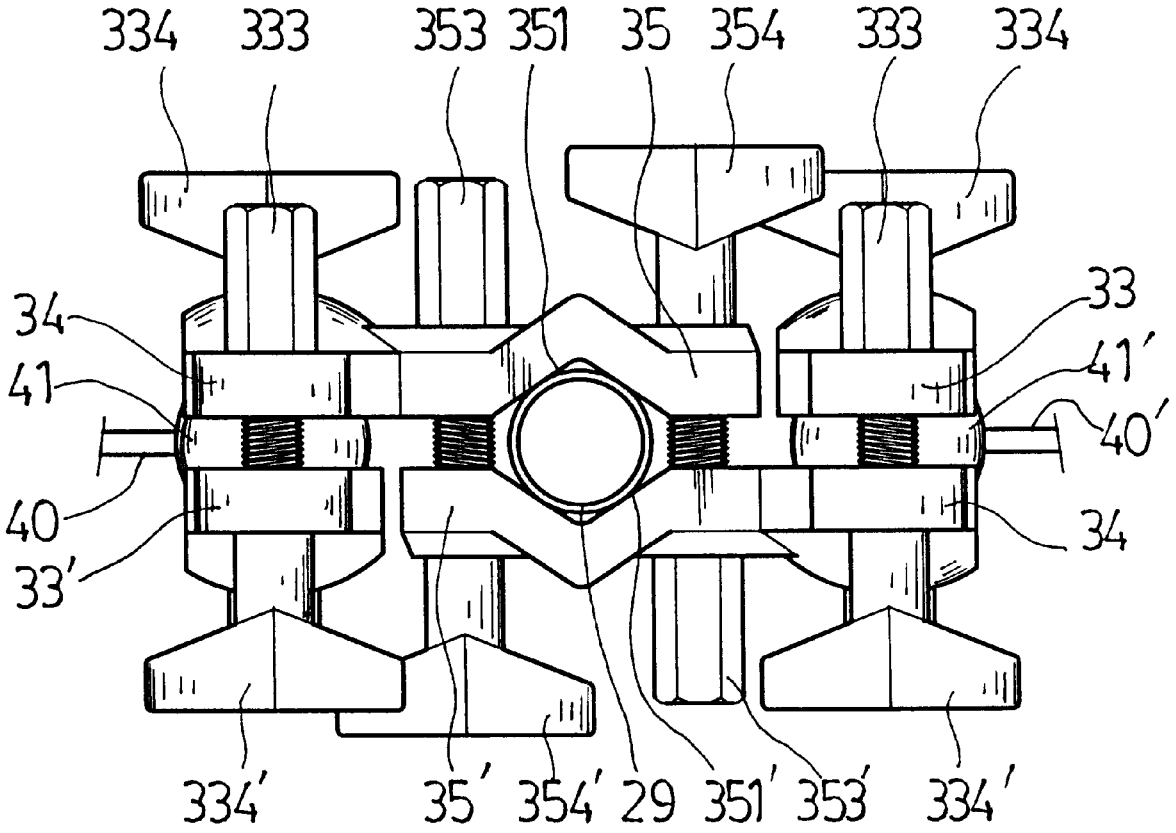
FIG. 5 is a top plain view of the holder unit shown in FIG. 4.

Referring to FIGS. 4 and 5 and FIG. 3 again, the holder unit 30 is fastened to the upright support rod 29 to hold a pair of side drums (tom-toms), comprised of two ball socket halves 31,31' mounted on the upright support rod 29 and fastened together, two balls 41,41' respectively rotatably mounted in between the ball socket halves 31,31' at two opposite sides relative to the upright support rod 29, and two supporting rods 40,40' respectively connected to the balls 41,41' and extended out of the ball socket halves 31,31' for holding a respective side drum (not shown). The ball socket halves 31,31' each comprise a mounting shell 32 or 32' and a holder shell 33 or 33'. The mounting shell 32 or 32' has a substantially T-shaped profile comprised of a vertical structure 34 or 34', and a horizontal structure 35 or 35'. The horizontal structure 35 or 35' comprises a transversely extended, recessed coupling portion 351 or 351' on the middle, and two mounting holes 352 or 352' horizontally spaced from the recessed coupling portion 351 or 351' at two opposite sides. The vertical structure 34 or 34' comprises a semi-spherical recess 341 or 341', and two mounting holes 342 or 342' vertically spaced from the semi-spherical recess 341 or 341' at two opposite sides. The wall surface of the semi-spherical recess 341 or 341' is preferably radially ribbed. The two mounting shells 32,32' of the ball socket halves 31,31' are reversely attached together and secured to the upright support rod 39 by inserting two screw bolts 353,353' through the mounting holes 352,352' from two opposite sides and then threading respective wind nuts 354,354' onto the screw bolts 353,353', permitting the recessed coupling portions 351,351' to be clamped on the periphery of the upright support rod 29. The holder shells 33,33' each comprise a semi-spherical recess 331 or 331', and two mounting holes 332 or 332' vertically spaced from the semi-spherical recess 331 or 331' at two opposite sides. The mounting holes 332,332' of the holder shells 33,33' are respectively fastened to the mounting holes 342,342' of the vertical structures 34,34' of the mounting shells 32,32' by screw bolts 333,333' and wing nuts 334,334', permitting the balls 41,41' to be respectively revolvably received in the semi-spherical recesses 331,341' and 331',341.

Referring to FIGS. from 3 through 6 again, when the screw bolts 333,333' are loosened, the balls 41,41' can be rotated in the respective semi-spherical recesses 331;341', 331';341 to move the respective supporting rod 40,40' to the desired angular position. When the holding down block 26 is loosened, the sliding bar 25 can be moved forwards and backwards along the longitudinal sliding groove 24 to the desired position.

Figure 7:
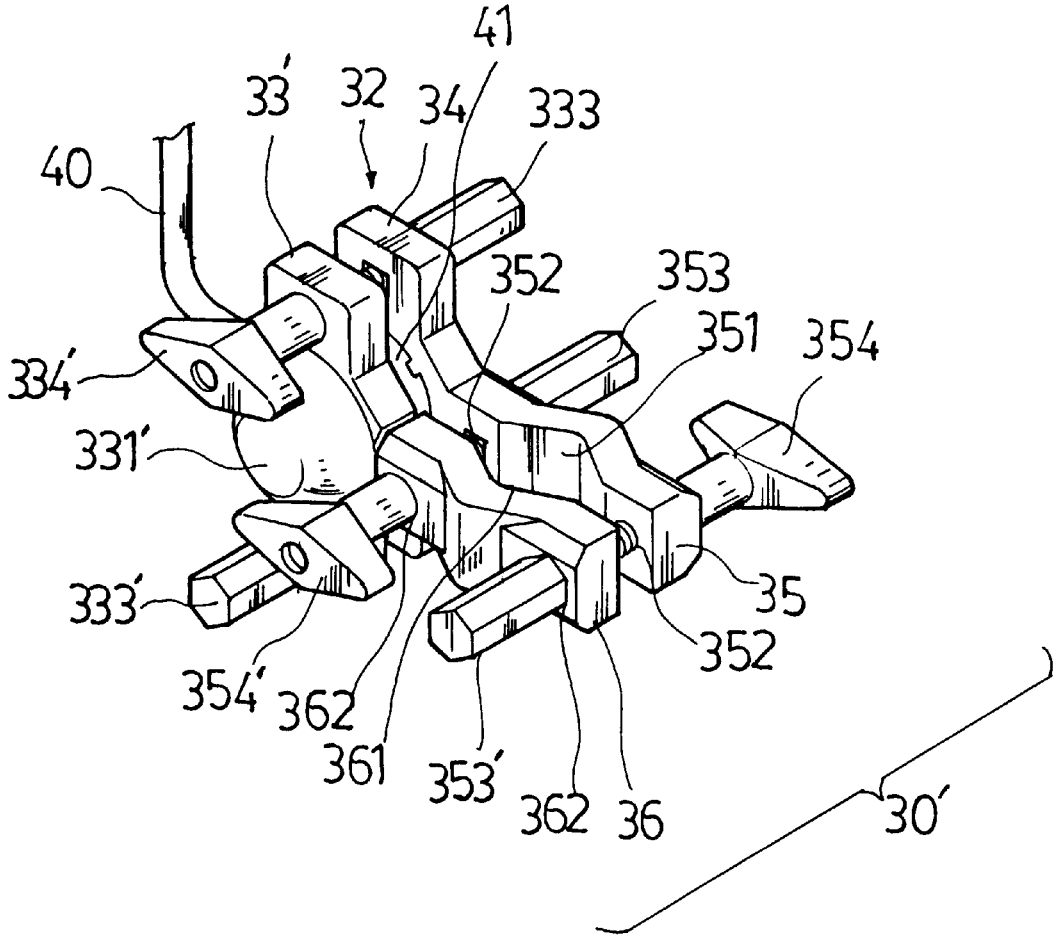
FIG. 7 is a perspective view of an alternate form of the holder unit according to the present invention.
Figure 8:
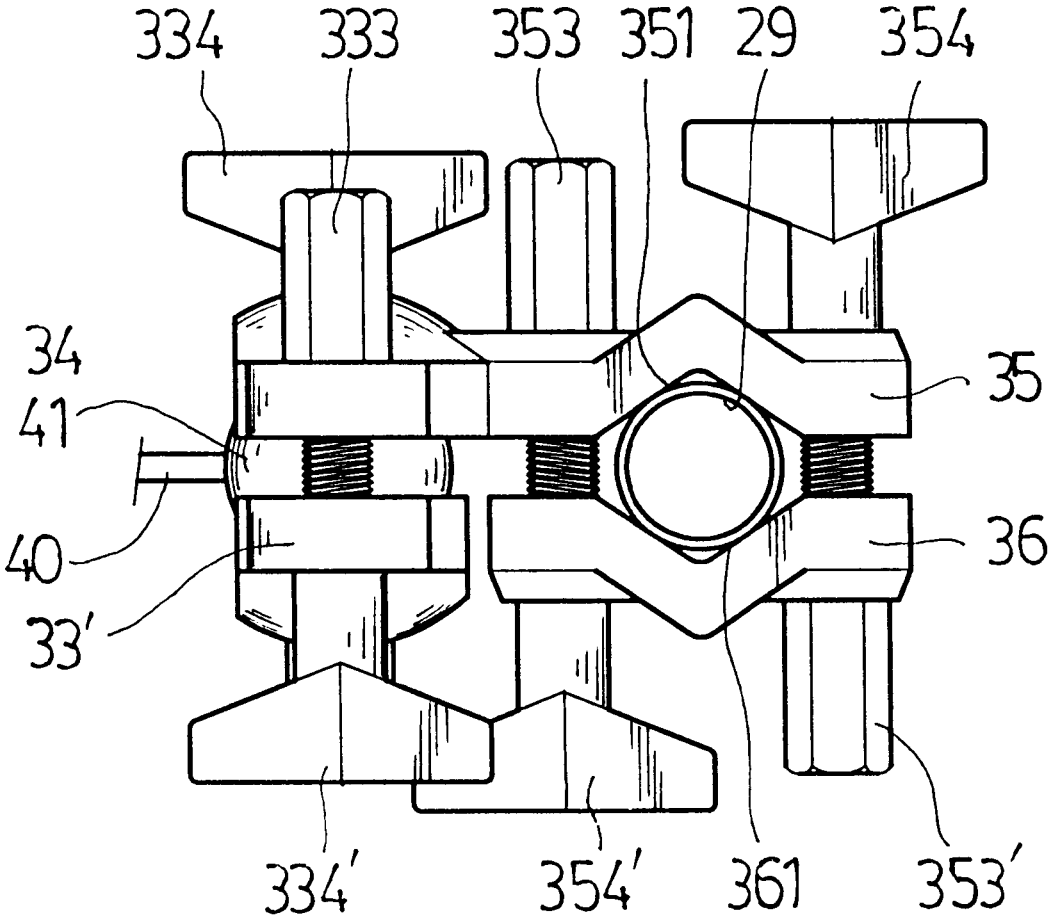
FIG. 8 is a top plain view of the holder unit shown in FIG. 7.

FIGS. 7 and 8 show an alternate form of the holder unit according to the present invention. According to this alternate form, the holder unit 30' comprises a first mounting shell 32 and a second mounting shell 36 fastened together and secured to the upright support rod 29 of the aforesaid mounting unit 20, a ball 41 rotatably mounted in between the mounting shells 32,36, and a supporting rod 40 connected to the ball 41 and extended out of the mounting shells 32,36 for holding a side drum. The first mounting shell 32 is identical to the mounting shell 32 shown in FIG. 4. The first mounting shell 32 and the second mounting shell 36 are symmetrical. The second mounting shell 36 comprises a transverse extended, recessed coupling portion 361 corresponding to the recessed coupling portion 351 of the first mounting shell 32, two horizontally spaced mounting holes 362 bilaterally spaced from the recessed coupling portion 361 and respectively fastened to the respective mounting holes 352 of at the first mounting shell 32 by screw bolts 353,353' and wing nuts 354,354', a holder shell 33' integral with one end thereof and fastened to the vertical structure 34 of the first mounting shell 32. The structure of the holder shell 33' of this alternate form of holder unit 30' is identical to the holder shell 33' shown in FIG. 4. This alternate form of holder unit 30' is designed for holding one side drum only. When the wing nuts 334,334' are loosened from the screw bolts 333,333' by hand, the ball 41 can then be rotated, enabling the supporting rod 40 to be moved to the desired angular position.

What is claimed is:

1. A combination side-drum holder comprising:

a mounting unit for mounting on the shell of a base drum, said mounting unit comprising an upright support rod; and a holder unit fastened to said upright support rod to hold two side drums, said holder unit comprised of two ball socket halves mounted on said upright support rod of said mounting unit and fastened together, two balls respectively rotatably mounted in between said ball socket halves at two opposite sides relative to said upright support rod f said mounting unit, and two supporting rod respectively raised from the said balls and extended out of said ball socket halves for holding a respective side drum, said ball socket halves each comprising a mounting shell and a holder shell, said mounting shell comprised of a vertical structure and a horizontal structure, said horizontal structure comprising a transversely extended, recessed coupling portion on the middle, and two mounting holes horizontally spaced from said recessed coupling portion at two opposite sides, said vertical structure comprising a semi-spherical recess, and two mounting holes vertically spaced from said semi-spherical recess at two opposite sides, the mounting holes of the horizontal structures of the two mounting shells of said ball socket halves being fastened together by respective screw bolts and wing nuts, permitting the recessed coupling portions of the horizontal structures of the two mounting shells of said ball socket halves to be clamped on the periphery of said upright support rod of said mounting unit, said holder shells each comprising a semi-spherical recess and two mounting holes vertically spaced from the semi-spherical recess of the respective holder shells at two opposite sides, the mounting holes of said holder shells being respectively fastened to the mounting holes of the vertical structures of said mounting shells by respective screw bolts and wing nuts, permitting said balls to be respectively revolvably received in the semi-spherical recesses of said ball socket halves.

2. The combination side-drum holder of claim 1 wherein said mounting unit further comprises:

a mounting plate for fastening to the shell of the base drum, said mounting plate comprising a smoothly curved bottom side wall fitting the curvature of the shell of the base drum, a longitudinal sliding groove longitudinally extended through the length at a top side thereof, pairs of first mounting holes disposed at two opposite sides of said longitudinal sliding groove for fastening to the shell of the base drum by fastening elements, and two second mounting holes disposed at two opposite sides of said longitudinal sliding groove on the middle;

a flat sliding bar perpendicularly connected to one end of said upright support rod and moved back and forth in said longitudinal sliding groove of said mounting plate; said flat sliding bar having a thickness greater than the depth of said longitudinal sliding groove of said mounting plate; and a holding down block transversely mounted on said mounting plate to hold down said sliding bar in position, said holding down block comprising two mounting holes respectively fastened to the second mounting holes at said mounting plate by a respective fastening element, and a recessed portion transversely disposed at a bottom side wall thereof on the middle, which receives said sliding bar.

3. A combination side-drum holder comprising:

a mounting unit for mounting on the shell of a base drum, said mounting unit comprising an upright support rod; and a holder unit fastened to said upright support rod to hold one side drum, said holder unit comprised of a first mounting shell and a second mounting shell fastened together fastened together and secured to said upright support rod of said mounting unit, a ball rotatably mounted in between said first and second mounting shells, and a supporting rod connected to said ball and extended out of said first and second mounting shells for holding a side drum, said first mounting shell and said second mounting shell each comprising a vertical structure and a horizontal structure, said horizontal structure comprising a transversely extended, recessed coupling portion on the middle, and two mounting holes horizontally spaced from the recessed coupling portion at two opposite sides, said vertical structure comprising a semi-spherical recess, and two mounting holes vertically spaced from the semi-spherical recess at two opposite sides, the mounting holes of the vertical structures of said first and second mounting shells being fastened together by respective screw bolts and wing nuts, permitting the ball to be rotatably received in the semi-spherical recess of the first and second mounting shells.

4. The combination side-drum holder of claim 3 wherein said mounting unit further comprises:

a mounting plate for fastening to the shell of the base drum, said mounting plate comprising a smoothly curved bottom side wall fitting the curvature of the shell of the base drum, a longitudinal sliding groove longitudinally extended through the length at a top side thereof, pairs of first mounting holes disposed at two opposite sides of said longitudinal sliding groove for fastening to the shell of the base drum by fastening elements, and two second mounting holes disposed at two opposite sides of said longitudinal sliding groove on the middle;

a flat sliding bar perpendicularly connected to one end of said upright support rod and moved back and forth in said longitudinal sliding groove of said mounting plate; said flat sliding bar having a thickness greater than the depth of said longitudinal sliding groove of said mounting plate; and a holding down block transversely mounted on said mounting plate to hold down said sliding bar in position, said holding down block comprising two mounting holes respectively fastened to the second mounting holes at said mounting plate by a respective fastening element, and a recessed portion transversely disposed at a bottom side wall thereof on the middle, which receives said sliding bar.

* * * * *